US005762420A

United States Patent [19]

Mills

[11] Patent Number: 5,762,420

[45] Date of Patent: Jun. 9, 1998

[54] DAMPER ACTUATOR CONTROLLER HAVING AN ENTHALPY SENSOR INPUT

[75] Inventor: Frank S. Mills, Bloomington, Minn.

[73] Assignee: Honeywell Inc., Minneapolis, Minn.

[21] Appl. No.: 591,071

[22] Filed: Jan. 25, 1996

[51] Int. Cl.[6] ..... F24F 11/04

[52] U.S. Cl. ..... 374/35; 236/44 C; 165/251; 374/109

[58] Field of Search ..... 62/176.6; 236/44 C, 236/91 C, 78 R; 374/35, 109; 340/601, 602; 165/251

[56] References Cited

U.S. PATENT DOCUMENTS

| | | | |
|---|---|---|---|
| 2,157,685 | 5/1939 | Anderson | 236/44 C |
| 3,456,455 | 7/1969 | Sapir | 236/78 R X |
| 4,078,431 | 3/1978 | Mott . | |
| 4,350,023 | 9/1982 | Kuwabara et al. | 62/176.6 |
| 4,353,409 | 10/1982 | Saunders et al. . | |
| 4,362,026 | 12/1982 | Miller . | |
| 4,379,484 | 4/1983 | Lom et al. . | |
| 4,506,514 | 3/1985 | Lamar et al. . | |
| 4,558,595 | 12/1985 | Kompelien . | |
| 4,570,448 | 2/1986 | Smith . | |
| 4,672,561 | 6/1987 | Katayama et al. | 374/35 X |
| 4,776,385 | 10/1988 | Dean . | |
| 4,987,952 | 1/1991 | Beal et al. . | |
| 5,274,334 | 12/1993 | Mills . | |
| 5,457,287 | 10/1995 | Wenner et al. | 62/176.6 X |

*Primary Examiner*—Harry B. Tanner
*Attorney, Agent, or Firm*—Ian D. MacKinnon

[57] ABSTRACT

A low-cost, accurate enthalpy sensor is described. The invention provides an on/off output which reflects the result of a comparison between the enthalpy level of a space and a predetermined setpoint. The sensor combines a signal representative of humidity with a signal representative of temperature to create a signal representative of enthalpy. The signal representative of enthalpy is compared with a predetermined setpoint to determine if the enthalpy level is above or below the setpoint. An output is then produced which indicates whether the output representative of enthalpy is above or below the predetermined setpoint.

11 Claims, 4 Drawing Sheets

DAMPER ACTUATOR CONTROLLER HAVING AN ENTHALPY SENSOR INPUT

BACKGROUND OF THE INVENTION

This invention relates generally to HVAC control components. More specifically this invention relates to an enthalpy sensor providing on/off output and externally controllable on-off setpoints.

Enthalpy sensors are used to provide an economizer function for heating and cooling systems, and indoor/outdoor air mixture systems. An enthalpy sensor measures air temperature and humidity to determine the most efficient mix of indoor and outdoor air to provide to a space. Enthalpy sensors typically provide an analog output or outputs to a control device. The control device then makes decisions regarding the air mixture, based on the enthalpy sensor signal or signals. Some devices provide temperature and humidity signals to a vent motor control circuit. In such a system the temperature and humidity signals are individually provided to a processor which calculates enthalpy from the separate temperature and humidity signals. The setpoint for enthalpy in such a device is in the motor control circuit, where it may be adjusted based on air circulation requirements or other factors. It is more convenient to locate the setpoint control in the motor control circuit, since the enthalpy sensor itself may be located in a location inconvenient for such adjustments. The enthalpy sensor may for instance be located on a rooftop.

In other systems, the enthalpy signal may be calculated in the enthalpy device itself, and a current or voltage representing the enthalpy is then supplied to the external motor control circuit. In these systems it may or may not be possible to externally control the enthalpy setpoint at the controller.

Since enthalpy systems must measure temperature to determine enthalpy, components which cause temperature variations internal to the sensor will add an undesirable error in sensor readings. In some cases it may be possible to compensate for this error component. Doing so however, requires additional components to eliminate the error. Consequently, the error may only be eliminated at increased cost to the sensor.

The prior art methods of measuring enthalpy suffer from two major drawbacks. First, prior art enthalpy systems which provide an analog current output signal require extra parts to produce this analog output. These parts increase significantly the cost of the device, as well as its overall size. Secondly, prior art enthalpy systems produce undesirable heating of the enthalpy sensor. Such heating causes errors in the enthalpy output. While correction is possible for this effect, it can only be achieved at increased cost to the system, and is difficult to achieve since the self heating causes errors in both the temperature and humidity sensor signals.

SUMMARY OF THE INVENTION

Accordingly, the present system provides an enthalpy sensor without the cost or temperature variations associated with analog current output circuitry.

The present invention provides an on/off output which reflects the result of a comparison between the enthalpy level of a space and a predetermined setpoint. The sensor combines a signal representative of humidity with a signal representative of temperature to create a signal representative of enthalpy. The signal representative of enthalpy is compared with a predetermined setpoint to determine if the enthalpy level is above or below the setpoint. An output is then produced which indicates whether the output representative of enthalpy is above or below the predetermined setpoint.

One object of the invention accordingly is to provide an enthalpy sensor with reduced component cost compared with prior art methods, while providing a comparable quality enthalpy sensor. A second object of the invention is to provide an enthalpy sensor with little or no temperature variation problems caused by the analog current output signal components. A further object of the invention is to provide remote access to the enthalpy setpoints.

Further objects of the invention will become apparent to one skilled in the art with examination of the specification, drawings and claims below.

DESCRIPTION OF THE PREFERRED EMBODIMENTS

Figure 1:
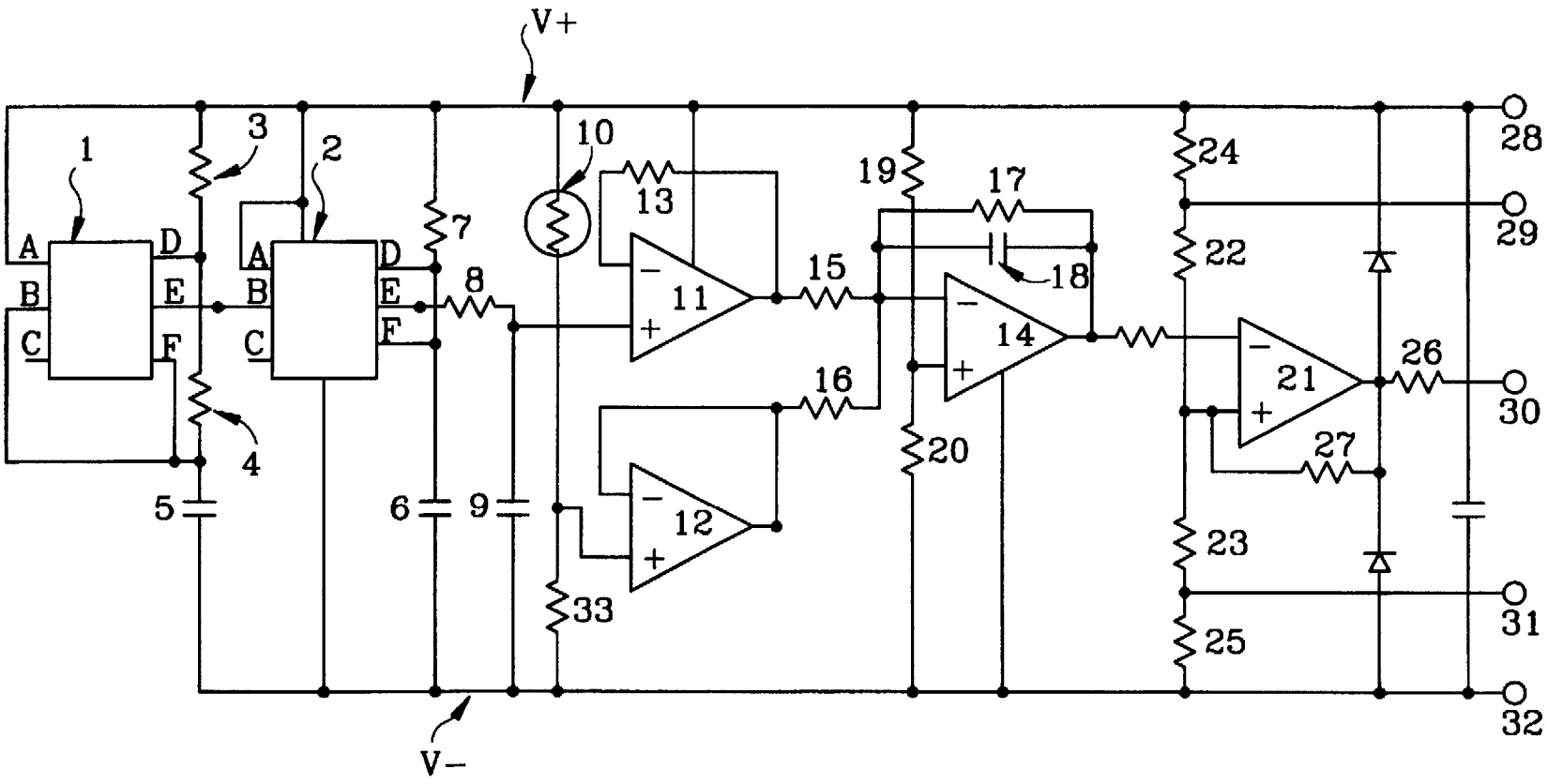
FIG. 1 is a schematic diagram of the preferred embodiment of the enthalpy sensor circuit.

FIG. 1 is a schematic diagram of the preferred embodiment of the enthalpy sensor circuit. The circuit comprises timers, 1 & 2, wherein node A of timers 1 & 2 is a reset node, node B is a trigger input node, node D is a discharge node, node E is an output node, and node F is a threshold node. Node A of timer 1 & 2 are electrically onnected to terminal 28 to provide reset on power-up. Terminal 28 is the positive voltage supply of V+. In the preferred embodiment, timers 1 & 2 are each ½ of an LMC556 from National Instruments, to reduce part count and overall cost. Timer 1 serves as a reference timer for timer 2 which provides a humidity dependent output at node E. Node E of timer 1 is electrically connected to node B of timer 2. Resistor 3 is electrically connected between node D of timer 1 and terminal 28. Resistor 4 is electrically connected between node D and node F of timer 1. Capacitor 5 is electrically connected between node F of timer 1 and terminal 32. Terminal 32 is the negative supply of V−. Resistors 3 & 4, and capacitor 5 collectively determine the pulse width at node E of timer 1.

Timer 2 provides an output at node E of timer 2 that is a variation of the duty cycle of the output provided by node E of timer 1. This variation is caused by changes in humidity. Capacitor 6, which is electrically connected between node F of timer 2 and terminal 32, is used to sense humidity. In the preferred embodiment, the capacitance of capacitor 6 will vary +/−50% with humidity. Resistor 7 is electrically connected between node D of timer 1 and terminal 28. Nodes D & F of timer 2 are shorted together. Resistor 7 and capacitor 6 collectively determine the pulse width at node E of timer 2.

The output from node E of timer 2 is integrated so that the square wave output of timer 2 is transformed into a voltage which varies with humidity. Integration is performed by resistor 8 and capacitor 9. Resistor 8 is electrically connected between node E of timer 2 and the positive input of op-amp 11. Capacitor 9 is electrically connected between the positive input of op-amp 11 and terminal 32.

In a preferred embodiment, low-cost thermistor 10 is electrically connected between terminal 28, and the positive input of op-amp 12. Thermistor 10 may for example be a Fenwall 175-502FAJ-001 or other device which provides a generally linear resistance varying with temperature. Thermistor 10 is chosen so that it resistance is linear over a range of temperature for which the enthalpy sensor is rated.

Resistor 33 is electrically connected between the positive input of op-amp 11 and terminal 32. Resistor 33 forms a voltage divider with thermistor 10.

Op-amps 11 and 12 may be of type LM2902 from National Instruments, or similar device. A LM2902 is preferred because the part provides four op-amps in a single package, reducing overall part count. Op-amps 11 and 12 buffer the input signals, and scale the relationship between the inputs so that one degree Fahrenheit will cause the same increase in the output voltage of op-amp 12 as a four percent change in humidity will cause in the output of op-amp 11. While other relationships between the temperature and humidity sensor inputs could be chosen, this choice of humidity to temperature provides the most acceptable control characteristic.

Feedback between the output and negative input of op-amps 11 and 12 is provided as is known to one skilled in the art. In the case of op-amp 11, resistor 13 is electrically connected between the output and negative input, while in the case of op-amp 12, a short electrically connects the output and negative input.

Figure 2:
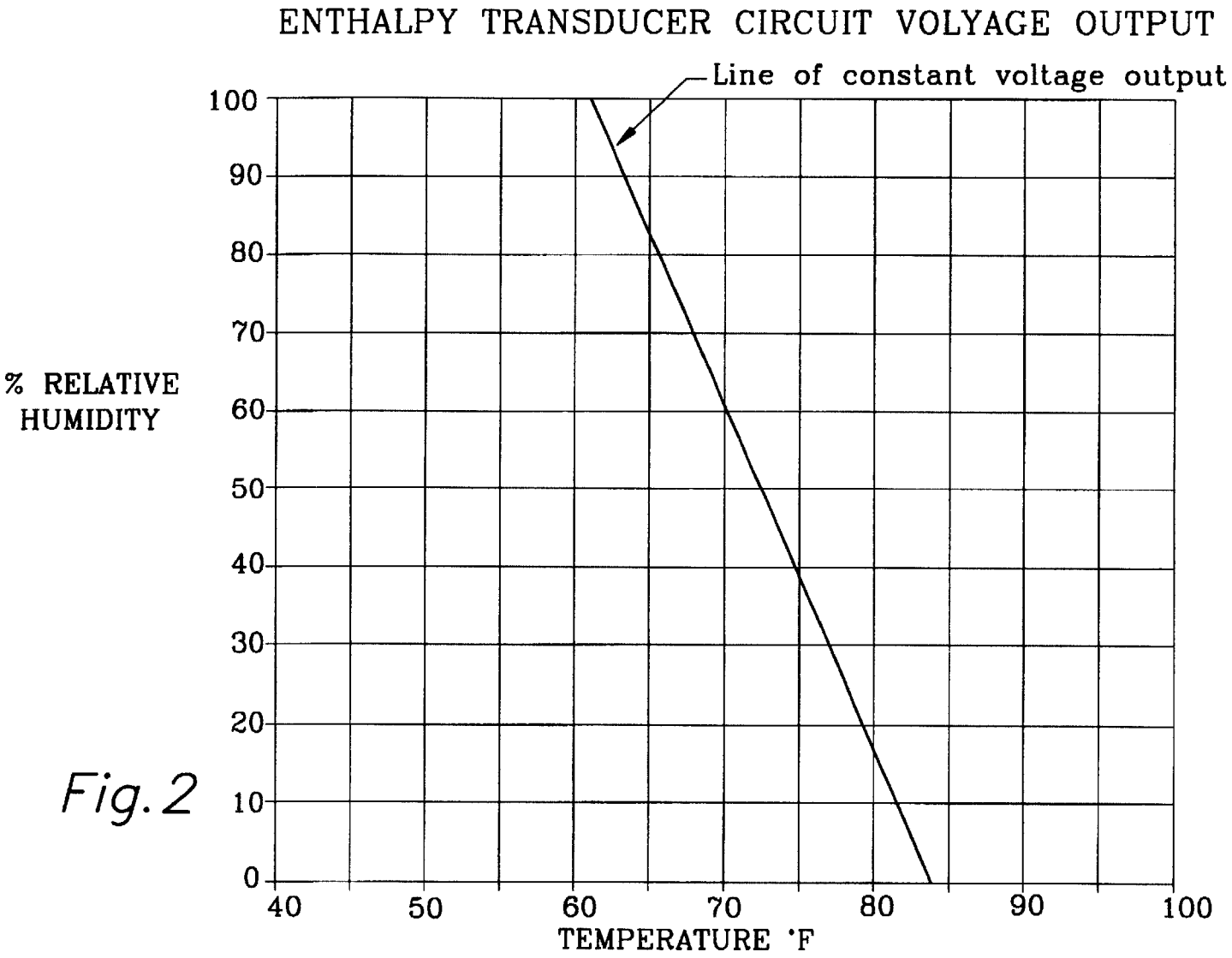
FIG. 2 shows the relationship between humidity and temperature with respect to the output of op-amp 14 of FIG. 1.
Figure 3:
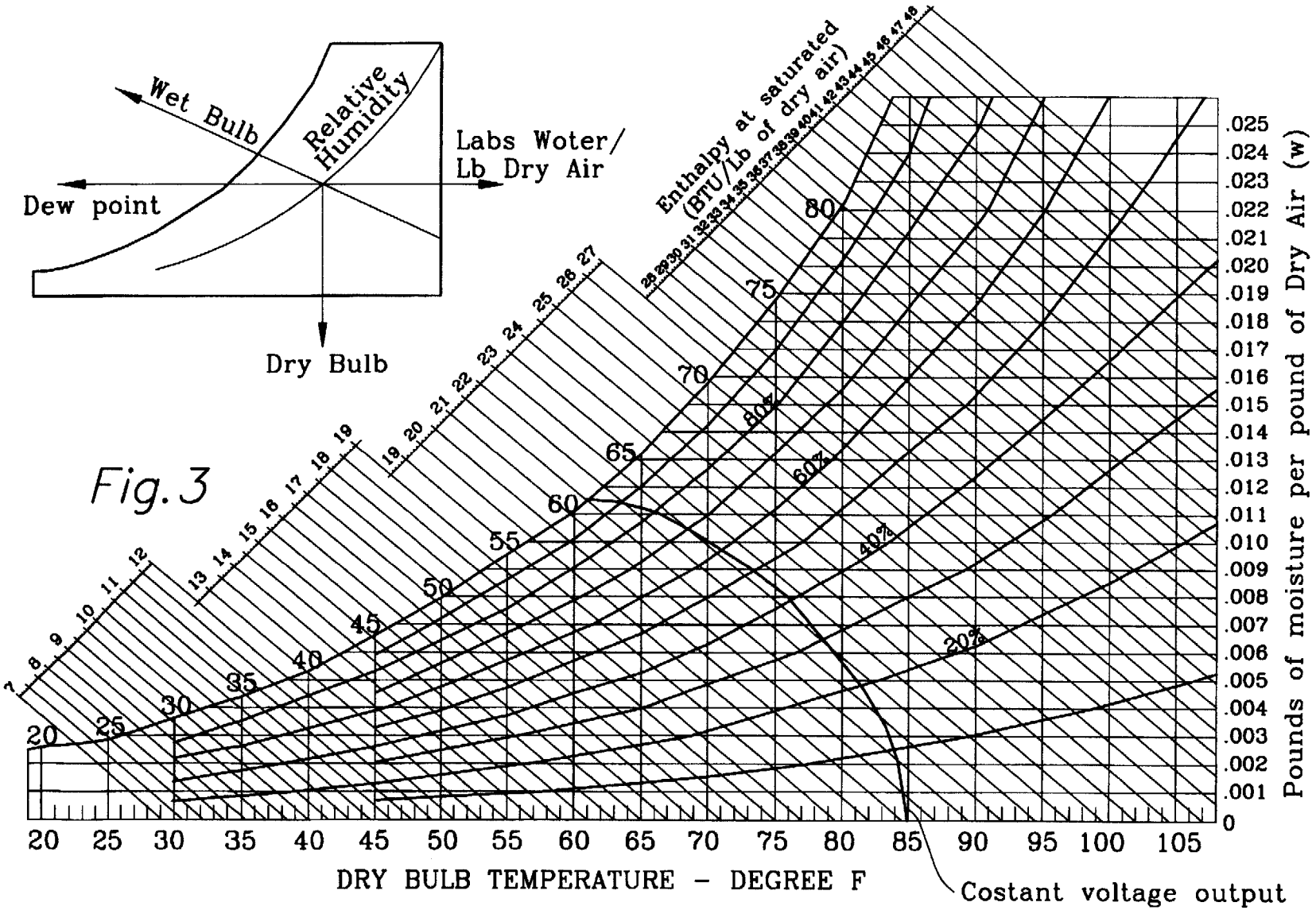
FIG. 3 repeats the graph of FIG. 2 on a Psychometric chart.

Op-amp 14 is the same type op-amps 11 & 12. Op-amp 14 receives an input at its negative input node from op-amps 11 & 12, and produces an analog output voltage related to enthalpy. The outputs from op-amps 11 & 12 are passed through resistors, 15 & 16 respectively, before connecting to the negative input of op-amp 14. FIGS. 2 & 3 characterize the output of op-amp 14. The straight line depicted in FIG. 2 represents a constant voltage at the output of op-amp 14 for the temperature and humidity which will produce that output. Conditions to the right of the line have higher enthalpy values. Conditions to the left of the line have lower enthalpy values. In FIG. 3 the same voltage is plotted on a Psychometric chart. Examination of the constant voltage line in FIG. 3 shows that it does not follow constant enthalpy. It follows well from saturation to about 50% RH and then turns downward. The term enthalpy is appropriate however since an enthalpy value immediately to the right of any point on the control line is always higher than the enthalpy immediately the left of that point on the control line. In fact, it is undesirable to control at constant enthalpy, since at low humidity the control point could require a temperature of over 100° F.

Gain resistor 17, and high frequency filtering capacitor 18 are connected between the output and negative input of op-amp 14. Resistors 19 is electrically connected between the positive input of op-amp 14 and terminal 28. Resistor 20 is electrically connected between the positive input of op-amp 14 and terminal 32. Resistors 19 & 20 provide a voltage divider which partially controls the overall gain of op-amp 14.

Op-amp 21 converts the analog signal from op-amp 14 into an on/off output. Resistor 34 is electrically connected between the negative input of op-amp 21 and the output of op-amp 14.

Op-amp 21 operates as a comparator. A voltage divider on the positive input of op-amp 21 is modified to select among three enthalpy setpoints. Resistors 22 & 23 are electrically connected to the positive input of op-amp 21. The other end of each resistor 22 & 23 is electrically connected to terminal 29 & 31 respectively. A second pair of resistors, 24 & 25 are electrically connected between terminals 28 & 29, and 31 & 32 respectively.

Setpoints are selected by shorting terminal 28 to 29 or 31 to 32. Either short changes the voltage divider on the positive input to op-amp 21. Changes in the voltage divider modify the voltage which will appear at the positive input of op-amp 21, and consequently switch the circuit between the three enthalpy level settings. One skilled in the art would be cognizant that more than three levels of setpoints may be provided by placing more resistors in the voltage divider circuit.

Resistor 27 is electrically connected between the output of op-amp 21 and terminal 32. Resistor 26 is electrically connected between the output of op-amp 21 and output terminal 30. Resistors 26 & 27 determine the final output voltage which will be sent to the controller.

Figure 4A:
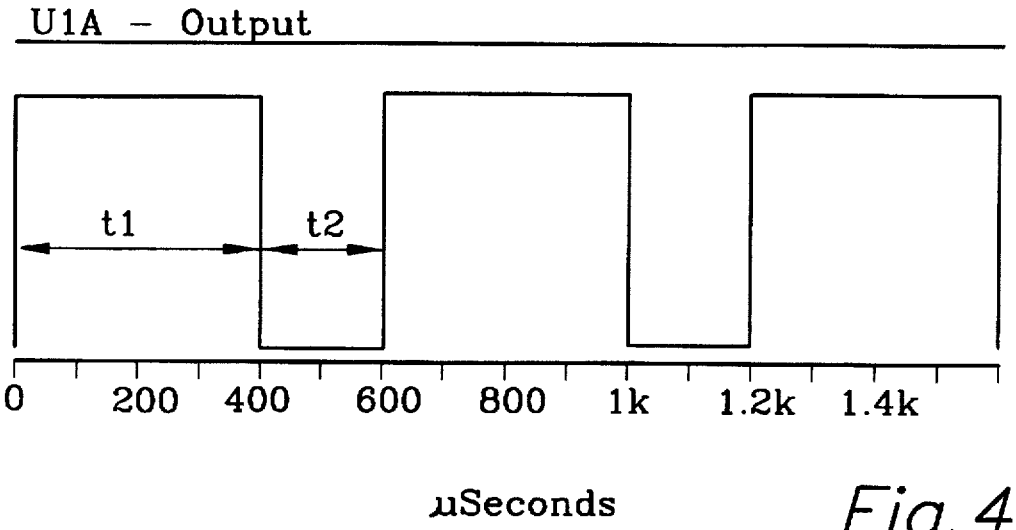
FIG. 4*a* shows the output pulse of timer 1.
Figure 4B:
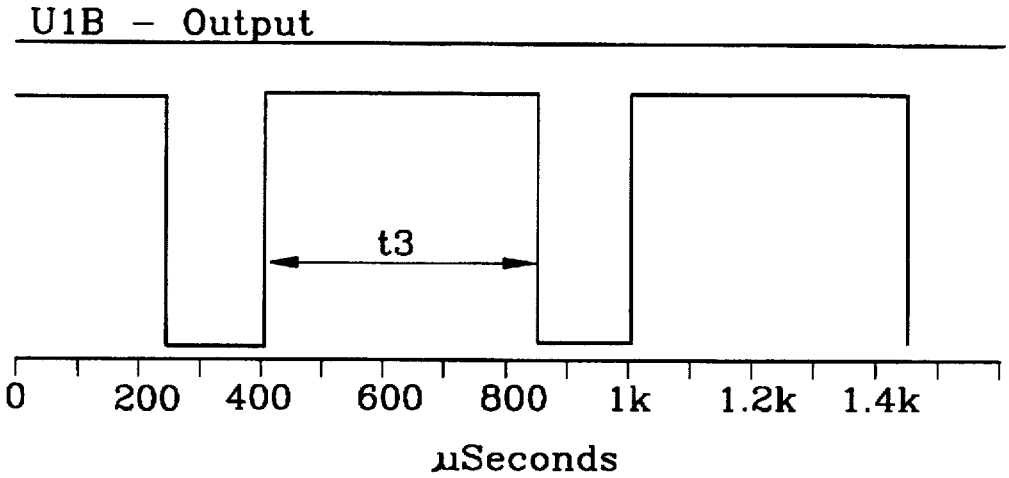
FIG. 4*b* shows the output pulse of timer 2.

In operation, resistors 3 & 4, and capacitor 5 will cause the output of timer 1 to produce a square wave as shown in FIG. 4*a*. The output pulse from node E of timer 1 is then input into node B of timer 2. The charge/discharge cycle of resistor 7 and capacitor 6 result in a square wave as shown in FIG. 4*b*.

Since capacitor 6 varies with humidity, the pulse width of the signal at node E of timer 2 will also vary with humidity. Resistor 8 and capacitor 9 integrate the output of timer 2, and provide a voltage representative of humidity to the input of op-amp 11. Thermistor 10 and voltage divider resistor 33 provide a voltage representative of temperature to the input of op-amp 12. Resistors 13, 15, & 16 are adjusted accordingly to provide a 4:1 ratio between the output of op-amp 11 and the output of op-amp 12. A 4:1 ratio of the outputs of op-amps 11 & 12 corresponds to the above mentioned one degree Fahrenheit to four percent humidity ratio. Resistors 17 & 20 control the output of op-amp 14 so that the voltage level will be approximately one-half way between terminals 28 & 32. This requirement is necessary for the comparator function of op-amp 21 to work properly.

As mentioned above, different setpoints can be selected by shorting either terminals 28 & 29 or 31 & 32 together. A short from terminals 28 to 29 will shift the voltage on the positive input of op-amp 21 to a higher voltage. The enthalpy-related voltage from op-amp 14 must now reach a higher voltage to trigger the output. This short consequently provides a HIGH enthalpy setting. A short between terminals 28 & 29 will shift the positive input of op-amp 21 to a lower voltage. The enthalpy-related voltage from op-amp 14 can now be a lower voltage to trigger the output. This short consequently provides a LOW enthalpy setting. If no shorts are used, a MEDIUM enthalpy setting is provided.

A controller in a central location is provided with electrical connection to terminals 28, 29, 30, 31 & 32 on the remotely located enthalpy sensor. In this way enthalpy settings may be changed, without having to go to the enthalpy sensor itself, by making the shorts described above.

Although a specific example of the applicant's enthalpy sensor has been shown and described for illustrative purposes, a number of variations and modifications within the applicant's contemplation and teaching will be apparent to those skilled in the art. It is not intended that coverage of the invention be limited to the embodiment disclosed.

What I claim is:

1. An enthalpy sensor comprising:

temperature sensing means, having an output representative of ambient temperature;

humidity sensing means, having an output representative of ambient humidity;

means for combining said output representative of ambient temperature with said output representative of ambient humidity and providing an output representative of enthalpy; and comparitor means for comparing said output representative of enthalpy with a predetermined setpoint, said comparitor means including a plurality of resistors forming a voltage divider circuit, said voltage divider circuit selecting said predetermined set point by selectively shorting said resistors.

2. The enthalpy sensor of claim 1 wherein:

said output representative of enthalpy reflects a linear relationship between temperature and humidity, and said linear relationship between said temperature and humidity is approximately one degree Fahrenheit to every four percent humidity.

3. The enthalpy sensor of claim 1 wherein each end of each plurality of resistors in said voltage divider circuit defines a terminal, remote access is provided to said terminals whereby one or more of said resistors may be shorted remotely.

4. The enthalpy sensor of claim 3 wherein said humidity sensing means includes:

a timer means, having an output, wherein the output of said timer means consists of a square wave, and wherein the pulse width of the square wave is humidity dependent.

5. The enthalpy sensor of claim 4 wherein said humidity sensing means includes a capacitor which is sensitive to changes in humidity.

6. The enthalpy circuit of claim 5 wherein said temperature sensing means comprises:

a thermistor, wherein said thermistor has linear characteristics over the operating range of the enthalpy circuit.

7. The enthalpy sensor of claim 4 wherein:

said output representative of enthalpy reflects a linear relationship between temperature and humidity, and said linear relationship between said temperature and humidity is approximately one degree Fahrenheit to every four percent humidity.

8. The enthalpy sensor of claim 1 wherein said humidity sensing means includes:

a timer means, having an output, wherein the output of said timer means consists of a square wave, and wherein the pulse width of the square wave is humidity dependent.

9. The enthalpy sensor of claim 8 wherein said humidity sensing means includes a capacitor which is sensitive to changes in humidity.

10. The enthalpy circuit of claim 9 wherein said temperature sensing means comprises:

a thermistor, wherein said thermistor has linear characteristics over the operating range of the enthalpy circuit.

11. The enthalpy sensor of claim 8 wherein:

said output representative of enthalpy reflects a linear relationship between temperature and humidity, and said linear relationship between said temperature and humidity is approximately one degree Fahrenheit to every four percent humidity.

* * * * *